US008889049B2

(12) United States Patent
Tam et al.

(10) Patent No.: US 8,889,049 B2
(45) **Date of Patent: *Nov. 18, 2014**

(54) PROCESS AND PRODUCT OF HIGH STRENGTH UHMW PE FIBERS

(75) Inventors: Thomas Y. Tam, Richmond, VA (US); John A. Young, Midlothian, VA (US); Qiang Zhou, Midlothian, VA (US); Conor J. Twomey, Waxhaw, NC (US); Charles Arnett, Richmond, VA (US)

(73) Assignee: Honeywell International Inc, Morristown, NJ (US)

( * ) Notice: Subject to any disclaimer, the term of this patent is extended or adjusted under 35 U.S.C. 154(b) by 566 days.

This patent is subject to a terminal disclaimer.

(21) Appl. No.: 12/771,856

(22) Filed: Apr. 30, 2010

(65) Prior Publication Data

US 2011/0268967 A1 Nov. 3, 2011

(51) Int. Cl.

| | |
|---|---|
| ***D01D 5/06*** | (2006.01) |
| ***D01D 5/12*** | (2006.01) |
| ***D01F 6/04*** | (2006.01) |

(52) U.S. Cl.

CPC ..... *D01F 6/04* (2013.01)
USPC ..... 264/184; 264/178 F; 264/203; 264/210.8

(58) Field of Classification Search

USPC ..... 264/184, 203, 178 F, 210.8
See application file for complete search history.

(56) References Cited

U.S. PATENT DOCUMENTS

| | | | |
|---|---|---|---|
| 4,344,908 | A | 8/1982 | Smith et al. |
| 4,413,110 | A | 11/1983 | Kavesh et al. |
| 4,430,383 | A | 2/1984 | Smith et al. |
| 4,551,296 | A | 11/1985 | Kavesh et al. |
| 4,663,101 | A | 5/1987 | Kavesh et al. |
| 5,032,338 | A | 7/1991 | Weedon et al. |
| 5,741,451 | A | 4/1998 | Dunbar et al. |
| 5,849,232 | A | 12/1998 | Ochi et al. |
| 6,287,689 | B1 | 9/2001 | Elliott et al. |
| 6,448,359 | B1 | 9/2002 | Kavesh |
| 6,770,365 | B2 | 8/2004 | Yoshimura et al. |
| 7,846,363 | B2 | 12/2010 | Tam et al. |
| 2005/0093200 | A1 | 5/2005 | Tam et al. |
| 2006/0145378 | A1 | 7/2006 | Kavesh |
| 2007/0237951 | A1 | 10/2007 | Sakamoto et al. |
| 2008/0048355 | A1 | 2/2008 | Tam et al. |
| 2008/0305331 | A1 | 12/2008 | Tam et al. |

FOREIGN PATENT DOCUMENTS

| | | | |
|---|---|---|---|
| JP | 2001-207339 | A | 8/2001 |
| JP | 2001-207340 | A | 8/2001 |
| JP | 2007-277763 | A | 10/2007 |
| WO | 2005/066401 | A1 | 7/2005 |

OTHER PUBLICATIONS

B. Kalb et al., "Maximum strength and drawing mechanism of hot drawn high molecular weight polyethylene," Journal of Materials Science, 1980, vol. 15, pp. 2584-2590.

Osamu Ishizuka et al., "Elongational viscosity in the isothermal melt spinning of polypropylene," Polymer, Jun. 1980, vol. 21, pp. 691-698.

James L. White et al., "Elongational Flow and Melt-Spinning Instability of Concentrated Suspensions of Small Particles in Polymer Melts," Journal of Applied Polymer Science, 1981, vol. 26, pp. 579-589.

Paul Smith et al., "Tensile Strength of Highly Oriented Polyethylene. II. Effect of Molecular Weight Distribution," Journal of Polymer Science: Polymer Physics Edition, 1982, vol. 20, pp. 2229-2241.

Albert J. Pennings et al., "Mechanical properties of ultra-high molecular weight polyethylene fibres in relation to structural changes and chain scissioning upon spinning and hot-drawing," Journal of Materials Science, 1984, vol. 19, pp. 3443-3450.

A. Chow et al., "Entanglements in Polymer Solutions under Elongational Flow: A Combined Study of Chain Stretching, Flow Velocimetry, and Elongational Viscosity," Macromolecules, 1988, vol. 21, pp. 250-256.

W. Hoogsteen et al., "Gel-spun polyethylene fibres, Part 2 Influence of polymer concentration and molecular weight distribution on morphology and properties," Journal of Materials Science, 1988, vol. 23, pp. 3467-3474.

Gwo-Geng Lin et al., "Measurement of Elongation Viscosity for Polymer Melts by Fiber Spinning," Advances in Polymer Technology, Fall 1997, vol. 16, No. 3, pp. 199-207.

D. Yan et al., "Effect of long chain branching on rheological properties of metallocene polyethylene," Polymer, 1999, vol. 40, pp. 1737-1744.

Paula M. Wood-Adams et al., "Effect of Molecular Structure on the Linear Viscoelastic Behavior of Polyethylene," Macromolecules, 2000, vol. 33, pp. 7489-7499.

Paula M. Wood-Adams et al., "Thermorheological Behavior of Polyethylene: Effects of Microstructure and Long Chain Branching," Macromolecules, 2001, vol. 34, pp. 6281-6290.

A. Makradi et al., "Effect of Non-Isothermal Oriented Crystallization on the Velocity and Elongational Viscosity Profiles During the Melt Spinning of High Density Polyethylene Fibers," Polymer Engineering and Science, Jul. 2001, vol. 41, No. 7, pp. 1107-1114.

F.N. Cogswell, Trans. Soc. Rheology, 16(3), 383-403 (1972).

*Primary Examiner* — Leo B Tentoni

(57) ABSTRACT

An improved process for solution spinning of ultra-high molecular weight polyethylene (UHMW PE) filaments, wherein the 10 wt % solution of the UHMW PE in mineral oil at 250° C. has a Cogswell extensional viscosity and a shear viscosity within select ranges.

13 Claims, 2 Drawing Sheets

PROCESS AND PRODUCT OF HIGH STRENGTH UHMW PE FIBERS

FIELD OF THE INVENTION

The present technology relates to an improved process for the preparation of ultra-high molecular weight polyethylene (UHMW PE) filaments, the filaments thereby produced, and yarns produced from such filaments.

DESCRIPTION OF RELATED ART

Multi-filament UHMW PE yarns, produced from polyethylene resins of ultra-high molecular weight, have been produced possessing high tensile properties such as tenacity, tensile modulus and energy-to-break. Multi-filament "gel spun" UHMW PE yarns are produced, for example, by Honeywell International Inc. The gel-spinning process discourages the formation of folded chain molecular structures and favors formation of extended chain structures that more efficiently transmit tensile loads. The yarns are useful in numerous applications.

Polyethylene resins of ultra-high molecular weight are produced, for example, in Japan, by Mitsui Chemicals, in Europe by Ticona Engineered Polymers and DSM; in Brazil by Braskem, in India by Reliance and by at least one company in China. The first commercial production of high strength, high modulus fibers from UHMW PE resin by solution spinning was by AlliedSignal Co. in 1985. In the two decades of commercial fiber production since then, experience has shown that UHMW PE resins having nominally the same molecular characteristics such as average molecular weight as measured by intrinsic viscosity, molecular weight distribution and level of short chain branching may process in very different ways. For example, ostensibly duplicate lots of UHMW PE resin from the same supplier have been found to process quite differently. Additionally, U.S. Pat. No. 5,032,338 noted and described the influence of the UHMW PE resin particle size and particle size distribution on processability.

Several process for the solution spinning of high molecular weight polymers have been described in the prior art. The solution spinning of high molecular weight polyethylene was described in U.S. Pat. Nos. 4,413,110; 4,344,908; 4,430,383; and 4,663,101 for example, all of which are hereby incorporated by reference. Additionally, a number of research publications identified several important parameters that influence the spinning process and the quality of the filaments produced.

B. Kalb and A. J. Pennings, *J. Matl. Sci.,* 15, 2584 (1980), for example, identified as key parameters the nature of the: spinning solvent, the polymer concentration and the spinning temperature. The influence of polymer molecular weight and molecular weight distribution were discussed by A. J. Pennings and J. Smook, *J. Matl. Sci.,* 19, 3443 (1984), by W. Hoogsteen et. al., *J. Matl. Sci.,* 23, 3467 (1988), and Smith et al., *J. Poly. Sci., Poly. Phys. Ed.,* 20, 229 (1982) among others.

Branching in polyethylene can be produced by the incorporation of co-monomers, or by the effect of chain transfer reactions during the course of polymerization. U.S. Pat. No. 4,430,383 limits the number of short co-monomer side chains to an average of less than 1 side chain per 100 carbon atoms, preferably less than 1 side chain per 300 carbon atoms. U.S. Pat. No. 6,448,359 limits the number of short side branches such as can be produced by incorporation of another alpha olefin to preferably less than 1 side branch per 1000 carbon atoms and most preferably less than 0.5 per 1,000 carbon atoms. PCT Publication No. WO2005/066401 teaches the desirability of incorporation of at least 0.2 or 0.3 small side groups per 1,000 carbon atoms.

The effect of long-chain branching on some rheological properties of essentially linear polyethylene have been discussed in a number of publications, including but not limited to: A Chow et al., "Entanglements in Polymer Solutions Under Elongational. Flow: A Combined Study of Chain Stretching, Flow Velocimetry and Elongational Viscosity" *Macromolecules,* 21, 250 (1988); P. M. Wood-Adams et al., "Effect of Molecular Structure on the Linear Viscoelastic Behavior of Polyethylene", *Macromolecules,* 33, 7489 (2000); D. Yan et al., "Effect of Long Chain Branching on Rheological Properties of Metallocene Polyethylene", *Polymer,* 40, 1737 (1999); and P. Wood Adams and S. Costeux, "Thermorheological Behavior of Polyethylene: Effects of Microstructure and Long Chain Branching", *Macromolecules,* 34, 6281 (2001).

SUMMARY OF THE INVENTION

The present technology relates to an improved process for the preparation of ultra-high molecular weight polyethylene (UHMW PE) filaments, as well as the filaments thereby produced, and yarns produced from such filaments.

In one aspect, a process for the preparation of filaments of UHMW PE is provided that includes the steps of:

a) selecting an UHMW PE having an intrinsic viscosity (IV) from about 5 dl/g to about 45 dl/g when measured in decalin at 135° C., wherein a 10 wt. % solution of the UHMW PE in mineral oil at 250° C. has a Cogswell extensional viscosity (A) in accordance with the following formula:

$$\lambda \geq 5{,}917(IV)^{0.8};$$

b) dissolving the UHMW PE in a solvent at elevated temperature to form a solution having a concentration of from about 5 wt. % to about 50 wt. % of UHMW PE;
c) discharging the solution through a spinneret to form solution filaments;
d) cooling the solution filaments to form gel filaments;
e) removing solvent from the gel filaments to form solid filaments containing less than about 5 wt. % of solvent;
f) stretching at least one of the solution filaments, the gel filaments and the solid filaments to a combined stretch ratio of at least 10:1, wherein the solid filaments are stretched to a ratio of at least 2:1.

In as second aspect, a process for the preparation of filaments of UHMW PE is provided that includes the steps of a) selecting an UHMW PE having an intrinsic viscosity from 5 to 45 dl/g when measured in decalin at 135° C., wherein a 10 wt. % solution of the UHMW PE in mineral oil at 250° C. has a Cogswell extensional viscosity and a shear viscosity such that the Cogswell extensional viscosity is at least eight times the shear viscosity;
b) dissolving the UHMW PE in a solvent to form a solution having a concentration of from about 5 wt. % to about 50 wt. % of UHMW PE;
c) discharging the solution through a spinneret to form solution filaments;
d) cooling the solution filaments to form gel filaments;
e) removing solvent from the gel filaments to form solid filaments containing less than about 5 wt. % of solvent;
f) stretching at least one of the solution filaments, the gel filaments and the solid filaments to a combined stretch ratio of at least 10:1, wherein the solid filaments are stretched to a ratio of at least 2:1.

In a third aspect, filaments are provided that are produced by the processes described herein. Yarns produced from the filaments are also provided.

BRIEF DESCRIPTION OF THE DRAWINGS

Specific examples have been chosen for purposes of illustration and description, and are shown in the accompanying drawings, forming a part of the specification.

DETAILED DESCRIPTION

Figure 1:
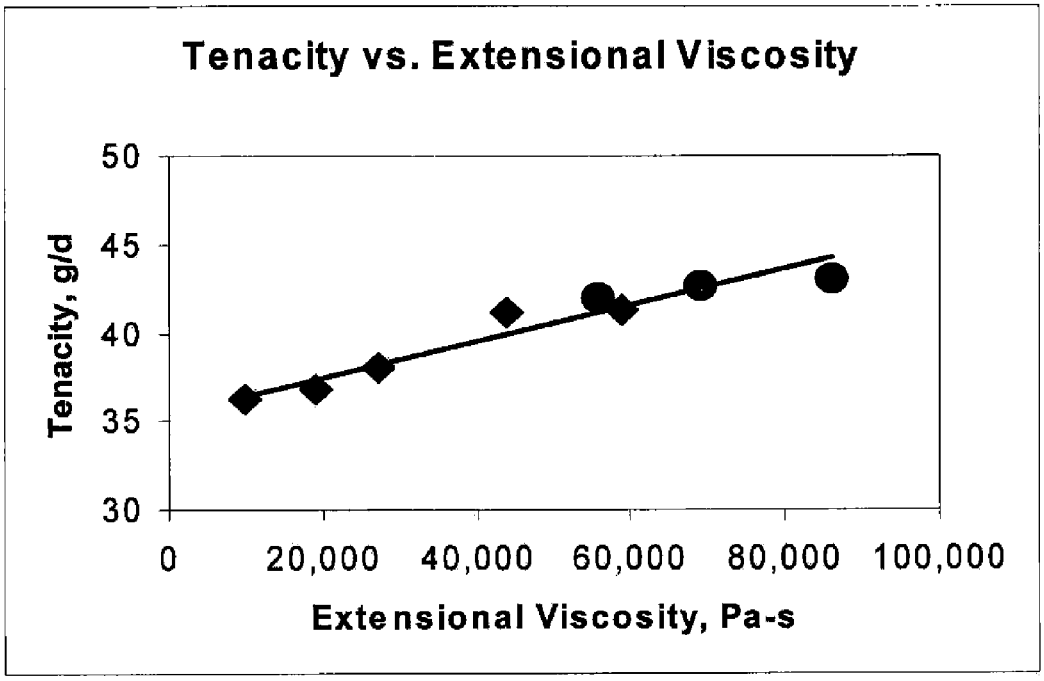
FIG. 1 is a plot of yarn tenacity versus the Cogswell extensional viscosity of a 10 wt. % solution of a UHMW PE resin in mineral oil at 250° C.; the yarn having been spun from a solution of that resin.

Processes for solution spinning UHMW PE filaments, as well as the filaments thereby produced, and yarns produced from such filaments, are provided herein that provide improved product properties. Ultra-high molecular weight polyethylene (UHMW PE) filaments and yarns can be utilized in a wide variety of applications, including, but not limited to, ballistic articles such as body armor, helmets, breast plates, helicopter seats, spall shields; composite materials utilized in applications including sports equipment such as kayaks, canoes, bicycles and boats; as well as in fishing line, sails, ropes, sutures and fabrics.

Methods for solution spinning UHMW PE fibers can include identifying and selecting UHMW PE resins for which excellent processability and fiber properties will be obtained. For example, the method can include selecting an UHMW PE having an intrinsic viscosity (IV) from about 5 dl/g to about 45 dl/g when measured in decalin at 135° C. In some examples, the UHMW PE resin can have an intrinsic viscosity (IV) measured in decalin at 135° C. of from about 7 dl/g to about 30 dl/g, from about 10 dl/g to about 28 dl/g, or from about 16 dl/g to about 28 dl/g.

A 10 wt. % solution of the UHMW PE in mineral oil at 250° C., meaning that there are 10 parts by weight of UHMW PE per 100 parts by weight of the total solution, can have a Cogswell extensional viscosity (λ) in Pascal-seconds (Pa-s) and a shear viscosity. In a first method of selecting an UHMW PE, the 10 wt. % solution of the UHMW PE in mineral oil at 250° C. can have a Cogswell extensional viscosity in accordance with the following formula:

$$\lambda \geq 5{,}917(IV)^{0.8}$$

In one such example, a 10 wt. % solution of the UHMW PE in mineral oil at a temperature of 250° C. can have a Cogswell extensional viscosity at least 65,000 Pa-s. In another example, a 10 wt. % solution of the UHMW PE in mineral oil at a temperature of 250° C. can have a Cogswell extensional viscosity (λ) in Pascal-seconds (Pa-s) in accordance with the following formula:

$$\lambda \geq 7{,}282(IV)^{0.8}$$

In yet another example, a 10 wt. % solution of the UHMW PE in mineral oil at a temperature of 250° C. can have a Cogswell extensional viscosity (2) in Pascal-seconds (Pa-s) in accordance with the following formula:

$$\lambda \geq 10{,}924(IV)^{0.8}$$

In some examples, the 10 wt. % solution of the UHMW PE in mineral oil at 250° C. has a Cogswell extensional viscosity that is both greater than or equal to $5{,}917(IV)^{0.8}$, $7{,}282(IV)^{0.8}$, or $10{,}924\ (IV)^{0.8}$, and is also at least five times greater than the shear viscosity if the solution.

In a second method of selecting an UHMW PE, the 10 wt. % solution of the UHMW PE in mineral oil at 250° C. can have a Cogswell extensional viscosity that is at least eight times the shear viscosity. In other words, the Cogswell extensional viscosity can be greater than or equal to eight times the shear viscosity, regardless of whether the Cogswell extensional viscosity is greater than or equal to 5,917(IV)0.8. In one example, a 10 wt. % solution of the UHMW PE in mineral oil at 250° C. has a Cogswell extensional viscosity and a shear viscosity such that the Cogswell extensional viscosity is at least eleven times the shear viscosity. In such examples, the Cogswell extensional viscosity can also be greater than or equal to $5{,}917\ (IV)^{0.8}$, $7{,}282(IV)^{0.8}$, or $10{,}924\ (IV)^{0.8}$.

Suitable UHMW PE resins can also comprise, consist essentially of, or consist of, a linear polyethylene with fewer than 10 short side branches per 1,000 carbon atoms, the short side branches comprising from 1 to 4 carbon atoms. For example, the UHMW PE can have fewer than 5 short side branches per 1,000 carbon atoms, fewer than 2 short side branches per 1,000 carbon atoms, fewer than 1 short side branch per 1,000 carbon atoms, or fewer than 0.5 short side branches per 1000 carbon atoms. Side groups may include but are not limited to $C_1$-$C_{10}$ alkyl groups, vinyl terminated alkyl groups, norbornene, halogen atoms, carbonyl, hydroxyl, epoxide and carboxyl.

Solution spinning UHMW PE fibers can also include dissolving the UHMW PE in a solvent at elevated temperature to form a solution having a concentration of from about 5 wt. % to about 50 wt. % of UHMW PE. The solvent used to form the solution can be selected from the group consisting of hydrocarbons, halogenated hydrocarbons and mixtures thereof. Preferably, the solvent used to form the solution can be selected from the group consisting of mineral oil, decalin, cis-decahydronaphthalene, trans-decahydronaphthalene, dichlorobenzene, kerosene and mixtures thereof.

Solution spinning UHMW PE fibers can also include discharging the solution through a spinneret to form solution filaments. Such a method of solution spinning UHMW PE fibers can also include cooling the solution filaments to form gel filaments, and can further include removing solvent from the gel filaments to form solid filaments containing less than about 10 wt. % of solvent, or less than about 5 wt % of solvent. The method of solution spinning UHMW PE fibers can also include stretching, or drawing, at least one of the solution filaments, the gel filaments and the solid filaments to a combined stretch ratio, or draw ratio, of at least 10:1, wherein the solid filaments are stretched to a ratio of at least 2:1. Any suitable drawing process can be utilized for stretching the filaments, including but not limited to the processes disclosed in U.S. patent application Ser. No. 11/811,569 to Tam et al., the disclosure of which is hereby incorporated by reference in its entirety.

In some examples, the UHMW PE solution can be formed, spun, and drawn in accordance with the processes described in U.S. Pat. Nos. 4,413,110; 4,344,908; 4,430,383; 4,663,101; 5,741,451; or 6,448,359; or in PCT Publication No. WO 2005/066401 A1.

The solution spinning methods disclosed herein produce solid filaments of solution spun UHMW PE. Additionally, a plurality of solid filaments can be combined to form a multifilament yarn that can have a tenacity of at least about 40 g/d (36 cN/dtex). Such filaments and yarns can be utilized in any suitable application.

Measurement of Shear Viscosity and Cogswell Extensional Viscosity

In conducting the processes of Solution spinning UHMW PE fibers described herein, the shear viscosity and the Cogswell extensional viscosity (λ) can be measured in accordance with the exemplary procedures described below.

A solution of UHMW PE was prepared at a concentration of 10 wt. % in HYDROBRITE® 550 PO white mineral oil, available from Sonneborn, Inc. The white mineral oil had a density of from about 0.860 g/cm$^3$ to about 0.880 g/cm$^3$ as measured by ASTM D4052 at a temperature of 25° C., and a kinematic viscosity of from about 100 cST to about 125 cSt as measured by ASTM D455 at a temperature of 40° C. The white mineral oil also consisted of from about 67.5% paraffinic carbon to about 72.0% paraffinic carbon, and from about 28.0% to about 32.5% napthenic carbon by ASTM D3238. The white mineral oil had a 2.5% distillation temperature of about 298° C. at 10 mm Hg as measured by ASTM D1160, and also had an average molecular weight of about 541 as measured by ASTM D2502.

The solution was formed at elevated temperature in a twin screw extruder, although other conventional devices, including but not limited to a Banbury Mixer, would also be suitable. The solution was cooled to a gel state, and the gel was charged to the identical twin barrels of a Dynisco Corp. LCR 7002 Dual Barrel Capillary Rheometer. Pistons were placed in the twin barrels of the rheometer. The barrels of the rheometer were maintained at a temperature of 250° C., and the polymer gel was converted back into a solution and was equilibrated at that temperature. The pistons were driven into the barrels of the rheometer simultaneously by a common mechanism.

The polymer solution was extruded through a capillary die at the exit of each barrel. The dies each had a capillary diameter (D) of 1 mm. One die had a capillary length (L1) of 30 mm; the other had a capillary length (L2) of 1 mm. Pressure transducers mounted above the dies measured the pressures (P1, P2) developed in each barrel.

The test proceeded by actuating the motion of the pistons at a series of speed steps increasing in ratios of about 1.2:1. The piston speeds and barrel pressures developed were recorded. The rheometer automatically stepped to the next speed level when a steady state has been achieved. The pressure and speed data were automatically transferred to a spread sheet program provided with the Dynisco Corp. LCR 7002 Dual Barrel Capillary Rheometer that performed the necessary calculations. The discharge rate (Q, cm3/sec) of the UHMW PE solution was calculated from the piston diameter and the piston speed.

The apparent shear stress at the wall of a capillary τa,i can be calculated from the relationship:

$$\tau_{a,i} = \frac{DP_i}{4L_i} \quad \text{Eq. 1}$$

where i is 1, 2 corresponding to barrel 1 or barrel 2

The apparent shear rate at the capillary wall can be calculated as:

$$\dot{\gamma}_{a,i} = \frac{32Q}{\pi D^3} \quad \text{Eq. 2}$$

The apparent shear viscosity can be defined as:

$$\eta_{a,i} = \frac{\tau_{a,i}}{\dot{\gamma}_{a,i}} \quad \text{Eq. 3}$$

A correction, known as the Rabinowitsch correction, can be applied to the shear rate to correct for the non-Newtonian character of the polymer solution. The true shear rate at the wall of the capillary can be calculated as:

$$\dot{\gamma}_i = \left[\frac{3n^* + 1}{4n^*}\right]\dot{\gamma}_{a,i} \quad \text{Eq. 4}$$

where n* is the slope of a plot of log $\tau_{a,i}$ versus log $\dot{\gamma}_{a,i}$.

A correction, known as the Bagely correction can be applied to the shear stress to account for the energy lost in funneling the polymer solution from the barrel into the die. This extra energy loss can appear as an increase in the effective length of the die. The true shear stress is given by:

$$\tau_i = \frac{D}{4L}(P_i - P_0) \quad \text{Eq. 5}$$

$P_0$ can be obtained from a linear regression of $P_1$ and $P_2$ versus $L_1$ and $L_2$. $P_0$ is the intercept at L=0.

The true shear viscosity can be obtained as a function of shear rate as follows:

$$\eta_i = \frac{\tau_i}{\dot{\gamma}_i} \quad \text{Eq. 6}$$

The shear viscosity can be defined as the value at a shear rate of 1 sec$^{-1}$.

As the polymer solution flows from the barrel of the rheometer into a die, the streamlines converge. Such a flow field can be interpreted as an extensional deformation superposed onto a simple shear flow. Cogswell, showed how these components can be treated separately as a way of measuring extensional rheology (F. N. Cogswell, *Trans. Soc. Rheology,* 16(3), 383-403 (1972)).

The extensional stress $\sigma_e$ and the extensional strain E can be given by Equations 7 and 8, respectively, as follows:

$$\sigma_e = 3/8(n+1)P_0 \quad \text{Eq. 7}$$

$$\varepsilon_i = \frac{4\eta_i\dot{\gamma}_i^2}{3(n+1)P_0)} \quad \text{Eq. 8}$$

The Cogswell extensional viscosity (λ) can then be calculated as follows $$\lambda_i = \frac{9(n+1)^2}{32\eta_i}\left(\frac{P_0}{\dot{\gamma}_i}\right)^2 \quad \text{Eq. 9}$$

where n in Eqs. 7-9 is the slope of a plot of log $\sigma_e$ versus log $\epsilon_i$.

For purposes of the invention, the Cogswell extensional viscosity can be defined as the value at an extensional rate of 1 sec$^{-1}$.

EXAMPLES

The following examples, including the specific techniques, conditions materials, proportions and reported data set forth therein, are exemplary and should not be construed as limiting the scope of the methods and products described herein.

Comparative Example 1

An UHMW PE resin was selected having an intrinsic viscosity (IV) of 19.4 dl/g measured in decalin at 135° C. Two or three calculations of the shear viscosity and the Cogswell extensional viscosity of a 10 wt % solution of the UHMW PE in HYDROBRITE® 550 PO white mineral oil at 250° C. were made in accordance with the procedures described above. The average calculated shear viscosity was 4,238 Pa-s, and the average calculated Cogswell extensional viscosity was 9,809 Pa-s. The Cogswell extensional viscosity was 63,437, which was less than the quantity $5{,}917(IV)^{0.8}$. The ratio of the Cogswell extensional viscosity to the shear viscosity was 2.31, so the Cogswell extensional viscosity was not at least eight times the shear viscosity.

The UHMW PE resin was dissolved in mineral oil at a concentration of 10 wt. % and spun into solution filaments in accordance with the process described in United. U.S. Pat. No. 4,551,296. The solution filaments were cooled to form gel filaments. The solvent was removed from the gel filaments to form solid filaments containing less than 5 percent by weight of solvent. The solution filaments, the gel filaments and the solid filaments were stretched to a combined stretch ratio of from 62:1 to 87:1, of which the stretch ratio of the solid filaments was from 3.7:1 to 5.1:1 in several trials.

Yarns were formed by combining 181 filaments. The tensile properties of the resulting 181 filament yarns averaged over all trials included: a denier of 917 (1019 dtex), a tenacity of 36.3 g/d (32.0 cN/dtex), and an initial tensile modulus (modulus of elasticity) of 1161 g/d (1024 cN/dtex). The stretch ratios and average tensile properties of the yarns are shown in Table I below, and the average yarn tenacity is plotted in FIGS. 1 and 2.

Comparative Examples 2-5

UHMW PE resins were selected having the intrinsic viscosities shown in Table I below. 10 wt. % solutions of the UHMW PE resins in HYDROBRITE® 550 PO white mineral oil at 250° C. were prepared. The averages of two or three determinations of the shear viscosities and the Cogswell extensional viscosities of the solutions for each resin were determined and are shown in Table I. In none of these comparative examples did the Cogswell extensional viscosity exceed the quantity $5719(IV)^{0.8}$, nor did the ratio of the Cogswell extensional viscosity to the shear viscosity exceed eight.

The UHMW PE resins were dissolved in mineral oil at a concentration of 10 wt. % and spun into solution filaments in accordance with the process of U.S. Pat. No. 4,551,296. The solution filaments were cooled to form gel filaments. The solvent was removed from the gel filaments to form solid filaments containing less than 5 percent by weight of solvent. The solution filaments, the gel filaments and the solid filaments were stretched to the combined stretch ratios shown in Table I. The corresponding solid stretch ratios are also shown in Table I. Yarns were formed containing 181 filaments, and the tensile properties of the resulting 181 filament yarns averaged over all trials are provided in Table I. The average yarn tenacities are plotted as diamonds in FIGS. 1 and 2.

Examples 1-3

UHMW PE resins were selected having the intrinsic viscosities shown in Table I below. 10 wt % solutions of the UHMW PE resins in HYDROBRITE® 550 PO white mineral oil at 250° C. were prepared. The averages of two or three determinations of the shear viscosities and the Cogswell extensional viscosities of the solutions for each resin were determined and are shown in Table I. In Examples 1 and 3, but not in example 2, the Cogswell extensional viscosity exceeded the quantity $5719(IV)^{0.8}$. In Example 2 and 3, but not in example 1, the Cogswell extensional viscosity was greater than eight times the shear viscosity.

The UHMW PE resins were dissolved in mineral oil at a concentration of 10 wt. % and spun into solution filaments in accordance with the process of U.S. Pat. No. 4,551,296. The solution filaments were cooled to form gel filaments. The solvent was removed from the gel filaments to form solid filaments containing less than 5 percent by weight of solvent. The solution filaments, the gel filaments and the solid filaments were stretched to the combined stretch ratios shown in Table I. The corresponding solid stretch ratios are also shown in Table I. Yarns were formed using 181 filaments, and the tensile properties of the resulting 181 filament yarns averaged over all trials are shown in Table I. The average yarn tenacities are plotted in FIGS. 1 and 2 as circles.

Figure 2:
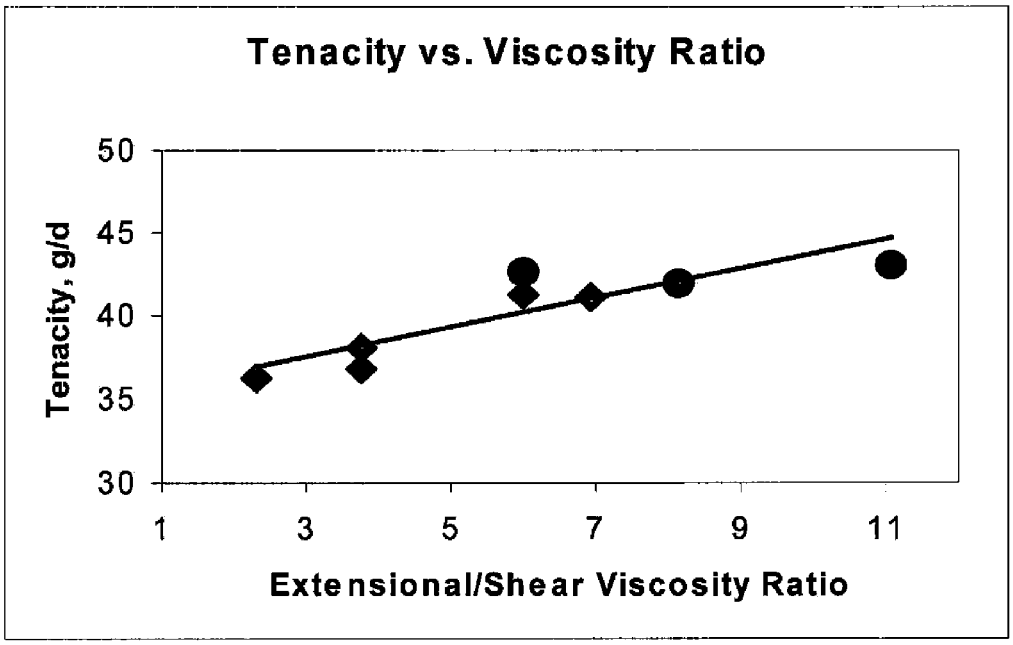
FIG. 2 is a plot of yarn tenacity versus the ratio between the Cogswell extensional viscosity and the shear viscosity of a 10 wt. % solution of the UHMW PE resin, in mineral oil at 250° C.; the yarn having been spun from a solution of that resin.

It will be seen from FIGS. 1 and 2 that yarn tenacity increased significantly as the Cogswell extensional viscosity increased and as the ratio of the Cogswell extensional viscosity to the shear viscosity increased. Although not plotted, a similar trend existed in the yarn tensile moduli (moduli of elasticity). As shown, selection of a UHMW PE resin yielding a solution of either high Cogswell extensional viscosity or high ratio of Cogswell extensional viscosity to shear viscosity, the process of the invention provides a novel and unexpected means to achieving superior yarn tensile properties.

TABLE I

| Comp. or Example No. | UHMW PE IV, dl/g | Shear Viscosity, Pa-s | Cogswell Extensional Viscosity, Pa-s | $5{,}917(IV^{0.8}$ | Extensional Viscoity/ Shear Viscosity | Overall Stretch | Solid Stretch | Yarn Avg. denier | Yarn Avg. dtex | Avg. Tenacity g/d | Avg. Tenacity cN/dtex | Avg. Modulus g/d | Avg. Modulus cN/dtex |
|---|---|---|---|---|---|---|---|---|---|---|---|---|---|
| Comp. 1 | 19.4 | 4,238 | 9,809 | 63,437 | 2.31 | 62-87 | 3.7-5.1 | 917 | 1019 | 36.3 | 32.0 | 1161 | 1024 |
| Comp. 2 | 21.1 | 6,334 | 43,845 | 67,847 | 6.92 | 80-99 | 4.8-5.9 | 788 | 876 | 41.1 | 36.3 | 1305 | 1151. |
| Comp.3 | 19.3 | 5,046 | 18,956 | 63,175 | 3.76 | 83-106 | 4.0-5.1 | 875 | 972 | 36.8 | 32.5 | 1162 | 1024 |
| Comp. 4 | 20.5 | 7,284 | 27,292 | 66,299 | 3.75 | 83-106 | 4.0-5.1 | 852 | 947 | 38 | 33.5 | 1270 | 1120 |
| Comp. 5 | 20.5 | 9,821 | 58,877 | 66,299 | 6.00 | 97-124 | 4.3-5.5 | 826 | 918 | 41.3 | 36.4 | 1336 | 1178 |
| 1 | 21.1 | 11,500 | 69,034 | 67,847 | 6.00 | 81-96 | 3.6-4.2 | 861 | 957 | 42.6 | 37.6 | 1374 | 1211 |

TABLE I-continued

| Comp. or Example No. | UHMW PE IV, dl/g | Shear Viscosity, Pa-s | Cogswell Extensional Viscosity, Pa-s | $5{,}917(IV)^{0.8}$ | Extensional Viscoity/ Shear Viscosity | Overall Stretch | Solid Stretch | Yarn Avg. denier | Yarn Avg. dtex | Avg. Tenacity g/d | Avg. Tenacity cN/dtex | Avg. Modulus g/d | Avg. Modulus cN/dtex |
|---|---|---|---|---|---|---|---|---|---|---|---|---|---|
| 2 | 19.7 | 6,871 | 55,945 | 64,221 | 8.14 | 76-97 | 3.3-4.1 | 858 | 953 | 42 | 37.0 | 1386 | 1222 |
| 3 | 20.5 | 7,752 | 85,935 | 66,299 | 11.09 | 92-103 | 3.6-4.5 | 780 | 867 | 43.1 | 38.5 | 1383 | 1219 |

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A process for the preparation of filaments of UHMW PE comprising the steps of:

a) selecting an UHMW PE having an intrinsic viscosity (IV) from about 5 dl/g to about 45 dl/g when measured in decalin at 135° C., wherein a 10 wt. % solution of the UHMW PE in mineral oil at 250° C. has a Cogswell extensional viscosity (λ) in accordance with the following formula:

$$\lambda \geq 5{,}917(IV)^{0.8};$$

b) dissolving the UHMW PE in a solvent at elevated temperature to form a solution having a concentration of from about 5 wt. % to about 50 wt. % of UHMW PE;

c) discharging the solution through a spinneret to form solution filaments;

d) cooling the solution filaments to form gel filaments;

e) removing solvent from the gel filaments to form solid filaments containing less than about 5 wt. % of solvent; and f) stretching at least one of the solution filaments, the gel filaments and the solid filaments to a combined stretch ratio of at least 10:1, wherein the solid filaments are stretched to a ratio of at least 2:1.

2. The process of claim 1, wherein the 10 wt. % solution of the UHMW PE in mineral oil at a temperature of 250° C. has an Cogswell extensional viscosity at least 65,000 Pa-s.

3. The process of claim 1, wherein the 10 wt. % solution of the UHMW PE in mineral oil at a temperature of 250° C. has a Cogswell extensional viscosity (λ) in accordance with the following formula:

$$\lambda \geq 7{,}282(IV)^{0.8}.$$

4. The process of claim 1, wherein the 10 wt. % solution of the UHMW PE in mineral oil at a temperature of 250° C. has a Cogswell extensional viscosity (λ) in accordance with the following formula:

$$\lambda \geq 10{,}924(IV)^{0.8}.$$

5. The process of claim 1 wherein the 10 wt. % solution of the UHMW PE in mineral oil at a temperature of 250° C. has a shear viscosity, and the Cogswell extensional viscosity is at least five times the shear viscosity.

6. The process of claim 1 wherein a 10wt. % solution of the UHMW PE in mineral oil at a temperature of 250° C. has an Cogswell extensional viscosity and a shear viscosity such that the Cogswell extensional viscosity is at least eight times the shear viscosity.

7. The process of claim 1 wherein a 10 wt. % solution of the UHMW PE in mineral oil at a temperature of 250° C. has an Cogswell extensional viscosity and a shear viscosity such that the Cogswell extensional viscosity is at least eleven times the shear viscosity.

8. A process for the preparation of filaments of UHMW PE comprising the steps of:

a) selecting an UHMW PE having an intrinsic viscosity from 5 to 45 dl/g when measured in decalin at 135° C., wherein a 10 wt. % solution of the UHMW PE in mineral oil at 250° C. has a Cogswell extensional viscosity and a shear viscosity such that the Cogswell extensional viscosity is at least eight times the shear viscosity;

b) dissolving the UHMW PE in a solvent to form a solution having a concentration of from about 5 wt. % to about 50 wt. % of UHMW PE;

c) discharging the solution through a spinneret to form solution filaments;

d) cooling the solution filaments to form gel filaments;

e) removing solvent from the gel filaments to form solid filaments containing less than about 5 wt. % of solvent;

f) stretching at least one of the solution filaments, the gel filaments and the solid filaments to a combined stretch ratio of at least 10:1, wherein the solid filaments are stretched to a ratio of at least 2:1.

9. The process of claim 8, wherein the 10 wt% solution of the UHMW PE in mineral oil at 250° C. has a Cogswell extensional viscosity and a shear viscosity such that the Cogswell extensional viscosity is at least eleven times the shear viscosity.

10. The process of claim 8, wherein the 10 wt. % solution of the UHMW PE in mineral oil at 250° C. has a Cogswell extensional viscosity (λ) in accordance with the following formula:

$$\lambda \geq 5{,}917(IV)^{0.8}.$$

11. The process of claim 8, wherein the 10 wt. % solution of the UHMW PE in mineral oil at a temperature of 250° C. has an Cogswell extensional viscosity at least 65,000 Pa-s.

12. The process of claim 8, wherein the 10 wt. % solution of the UHMW PE in mineral oil at a temperature of 250° C. has a Cogswell extensional viscosity (λ) in accordance with the following formula:

$$\lambda \geq 7{,}282(IV)^{0.8}.$$

13. The process of claim 8, wherein the 10 wt. % solution of the UHMW PE in mineral oil at a temperature of 250° C. has a Cogswell extensional viscosity (λ) in accordance with the following formula:

$$\lambda \geq 10{,}924(IV)^{0.8}.$$

* * * * *